US005580127A

United States Patent [19]

Piretti

[11] Patent Number: 5,580,127

[45] Date of Patent: Dec. 3, 1996

[54] CHAIR WITH TILTING BACKREST

[75] Inventor: Giancarlo Piretti, Bologna, Italy

[73] Assignee: Pro-Cord S.r.l., Bologna, Italy

[21] Appl. No.: 249,193

[22] Filed: May 26, 1994

[30] Foreign Application Priority Data

May 27, 1993 [IT] Italy ..... TO93A0363

[51] Int. Cl.[6] ..... A47C 3/00

[52] U.S. Cl. ..... 297/301.3; 297/291; 297/301.5

[58] Field of Search ..... 297/291, 299, 297/301.1, 301.3, 301.5, 303.3

[56] References Cited

U.S. PATENT DOCUMENTS

| | | | |
|---|---|---|---|
| 2,711,211 | 6/1955 | Tidcombe | 297/291 |
| 3,136,580 | 6/1964 | Parrott | 297/304 |
| 4,938,532 | 7/1990 | Burgess | 297/301 |
| 5,100,201 | 3/1992 | Becker, III et al. | 297/306 |

FOREIGN PATENT DOCUMENTS

| | | | |
|---|---|---|---|
| 1471014 | 2/1967 | France | 297/304 |

*Primary Examiner*—Peter R. Brown

*Attorney, Agent, or Firm*—Sughrue, Mion, Zinn, Macpeak & Seas

[57] ABSTRACT

In a chair having a backrest which can be reclined backwardly against the action of spring means, the latter comprises a leaf spring having its central portion operatively connected to the base structure of the chair and its ends connected to two side arms which support the backrest.

6 Claims, 6 Drawing Sheets

CHAIR WITH TILTING BACKREST

BACKGROUND OF THE INVENTION

The present invention relates to chairs of the type comprising a base structure, a seat supported by the base structure and a backrest having a support structure pivotally mounted on said base structure around a transverse horizontal axis and movable between a relatively upright position and a backwardly reclined position, and spring means biasing said backrest towards its upright position.

In recent years, there has been more and more research in order to provide chairs characterized by a sitting posture which is ergonomically proper and of maximum comfort even in the field of chairs to be used in public places, such as cinemas, theatres, auditoriums or meeting and conference rooms and the like. Naturally, the structure of a chair of this type must be necessarily simple and of low cost. Therefore, the designers have been compelled to seek for compromise solutions between the opposite needs which have been mentioned above, no completely satisfactory solution being found to date.

The applicant started from considering that even a chair to be used in a public place must be provided, in a way similar to what usually happens for office chairs, with a tilting backrest biased elastically towards it upright position.

SUMMARY OF THE INVENTION

Therefore, the object of the invention is that of providing a chair of the type indicated at the beginning of the present description which on one hand solves the above mentioned problems satisfactorily, so as to have a particularly advantageous application in the field of seats of chairs for public use and, on the other hand, is able to be used advantageously even in different fields, such as in the field of office chairs or house chairs.

In view of achieving the above indicated object, the invention provides a chair, comprising a base structure, a seat supported by the base structure and a backrest having a support structure pivotally mounted on said base structure around a transverse horizontal axis and movable between a relatively upright position and a backwardly reclined position, and spring means which bias the backrest towards its upright position, characterized in that said spring means comprise a leaf spring arranged along said articulation axis of said backrest support structure and having its central portion operatively connected to said base structure and its ends connected to said backrest support structure.

Each half portion of said leaf spring acts as a torsion bar rigidly connected to the base structure at the centre of the leaf spring and connected to said backrest at the respective end of the leaf spring. Therefore, this arrangement provides the effects of two torsion bars respectively associated with the two sides of the backrest, with the advantage however of having a structure extremely simple and of low costs, as well as easy and quick to be mounted.

In the preferred embodiment of the present invention, the base structure includes a tubular cross member which has said leaf spring arranged inside, said tubular cross member having at its centre at least a inner stop element which limits the rotation of the leaf. The backrest support structure includes two side arms comprising two coaxial pins rotatably mounted within the opposed ends of said tubular cross member, each pin and the respective end of the tubular cross member being provided with stop means cooperating with each other so as to limit the tilting angular movement of said pins with respect to the tubular cross member between two end positions corresponding to the upright position and the backward reclined position of the backrest respectively, said arrangement being such that when the backrest is in its upright position, each half portion of the leaf spring is subject to a torsion load which tends to hold the backrest in such position.

Also in said preferred embodiment, the tubular cross member comprises a sheet metal tube having at its centre two diametrically opposed areas which are inwardly deformed, against which the central part of the leaf spring abuts when the backrest is reclined backwardly. Furthermore, said stop means interacting between the ends of the tubular cross members and the respective pins which are rotatably mounted within such ends, comprises for each end of the tubular cross member a transverse member carried by said pin and having each end engaged within a circumferential slot formed in the wall of the tubular cross member.

Naturally, the above described mechanism can be applied to chairs of many different types.

BRIEF DESCRIPTION OF THE DRAWINGS

Further embodiments and details of construction will become apparent from the following description with reference to the annexed drawings, given purely by way of non limiting example, in which.

DETAILED DESCRIPTION OF THE INVENTION

Figure 1:
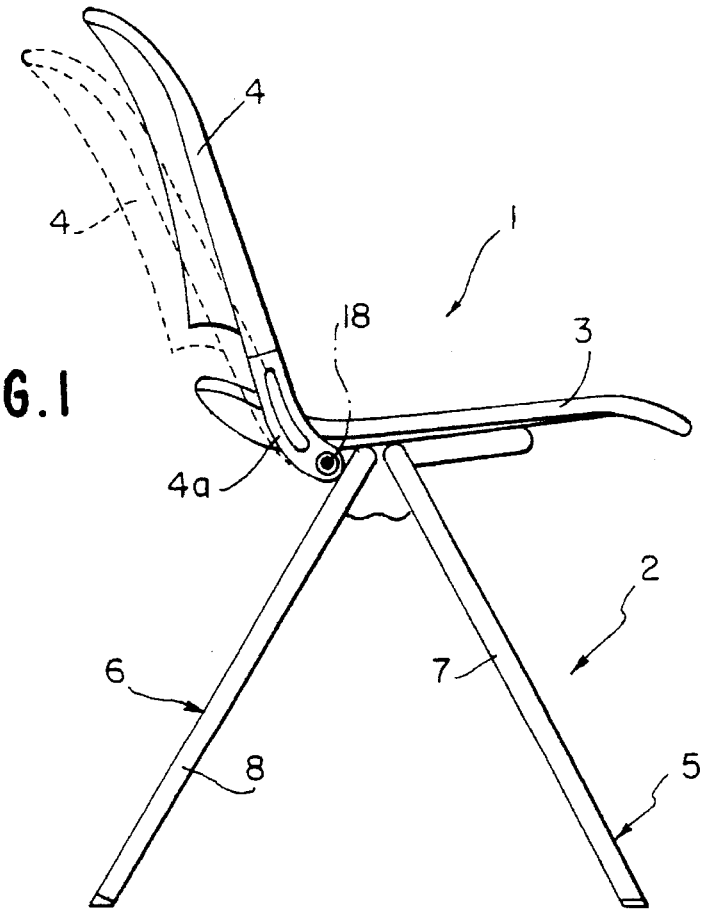
FIG. 1 is a side elevational view of a first embodiment of a chair according to the invention.
Figure 2:
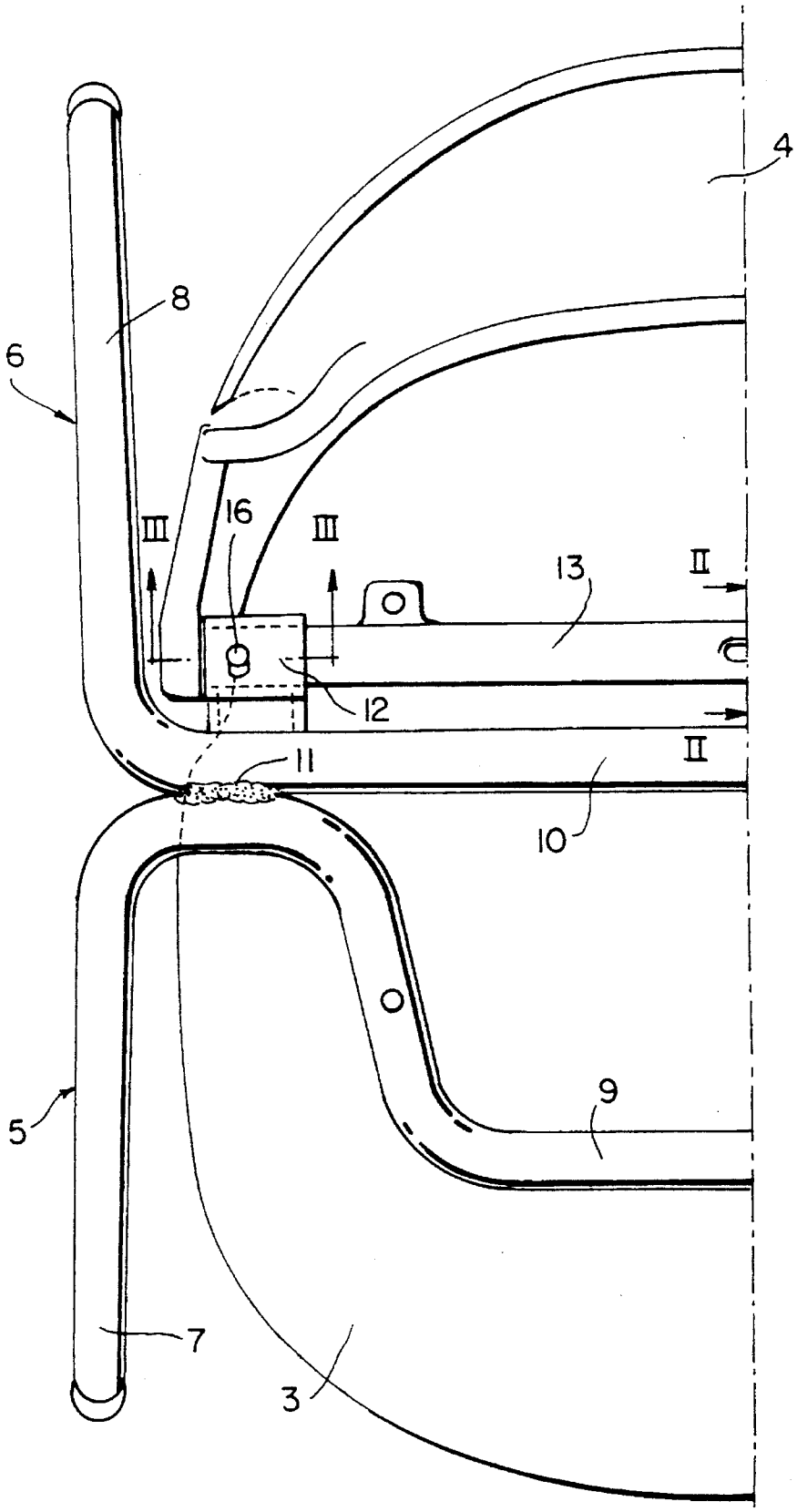
FIG. 2 is a partial bottom view and on an enlarged scale of the chair of FIG. 1, FIG. 2*a* a cross sectional view taken along line II—II of FIG. 2.

With reference to FIGS. 1, 2, numeral 1 generally designates a chair comprising a base structure 2 which supports a seat 3 and a backrest 4. The base structure 2 comprises two bent tubular elements 5, 6, welded to each other and defining respectively the two front legs 7 and the two rear legs 8. Each of the two tubular elements 5, 6 has a general U-shaped configuration. Element 5 has two wings which define the front legs 7 of the chair and a central portion 9 (FIG. 2) which on its turn is U-bent in a horizontal plane, on which the seat 3 is fixed. The U-shaped element 6 has two wings which define the rear legs 8 and a central straight portion 10 welded to element 5 at its ends 11, one of which is visible in FIG. 2. The central straight portion 10 rigidly supports in a cantilever fashion two end bushes 12 (FIGS. 3, 4) inside which there are welded the ends of a tubular cross member of sheet metal 13 which therefore is rigidly connected to the base structure of the chair.

Figure 3:
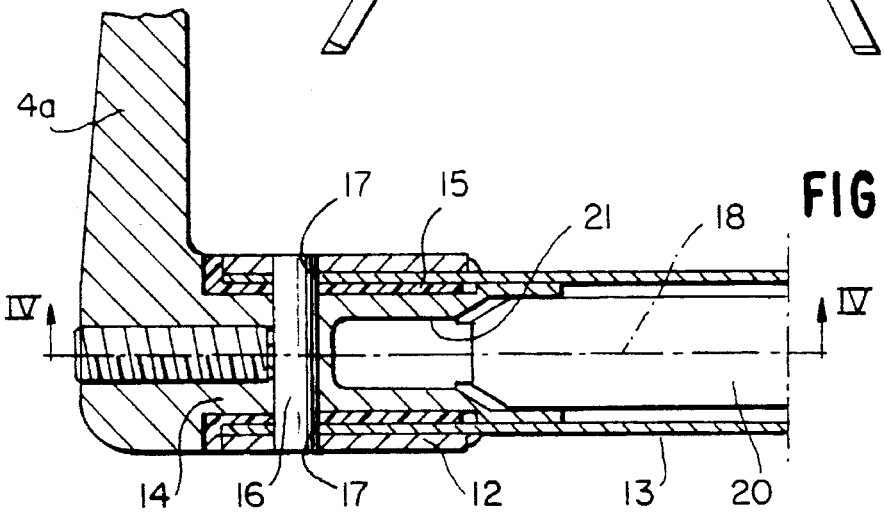
FIG. 3 is a cross sectional partial view and on an enlarged scale taken along line III—III of FIG. 2.
Figure 4:
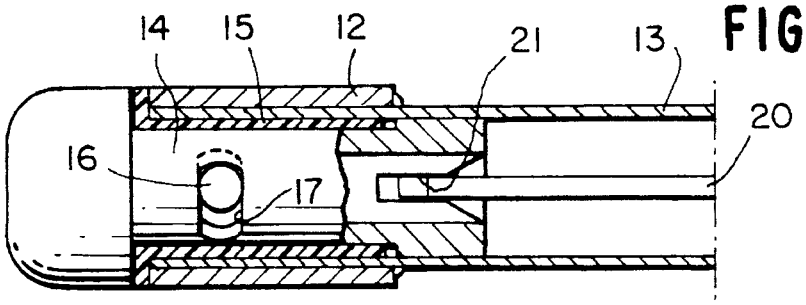
FIG. 4 is a partially sectioned view taken along line IV—IV of FIG. 3.

The backrest 4 of the chair is provided with a support structure comprising two side arms 4*a* each of which ends with a cylindrical pin 14 which is rotatably mounted within the respective end of the tubular cross member 13 with the interposition of a bush 15 of plastics material having a low friction. Each pin 14 is crossed by a transverse member 16 having each of its two ends engaged within a circumferential slot 17 formed in the respective bush 12, so that the angular tilting movement of the backrest 4 around axis 18 of the tubular cross member 13 is limited between two end positions respectively corresponding to a relatively upright position and a backwardly reclined position of the backrest, respectively shown with undotted line and with dotted line in FIG. 1. In FIG. 3, reference numeral 9 designates a screw for locking the transverse member 16, engaged within each side arm 4*a* of the backrest.

Figure 2A:
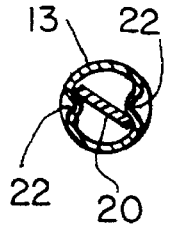
Figure 6:
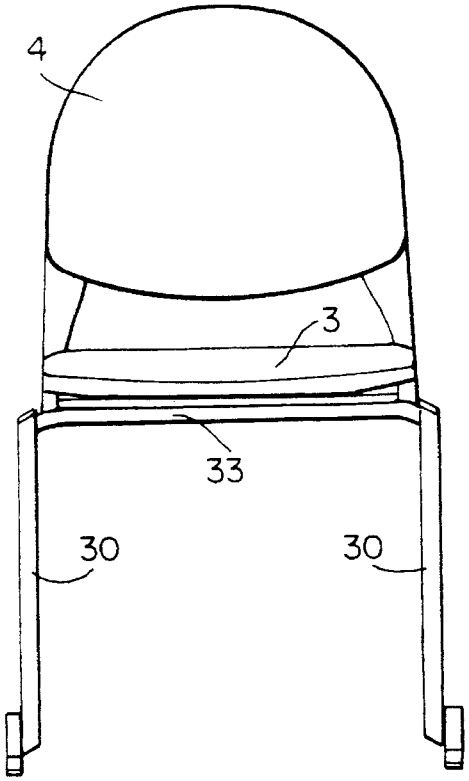
FIGS. 6, 7 show a front and a plan view of the chair of FIG. 5.
Figure 5:
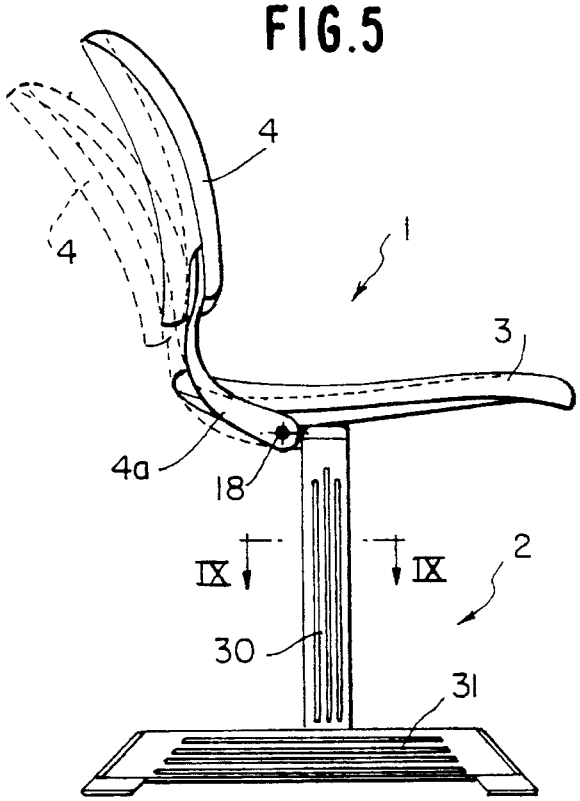
FIG. 5 is an elevational side view of a second embodiment of the chair according to the invention.
Figure 7:
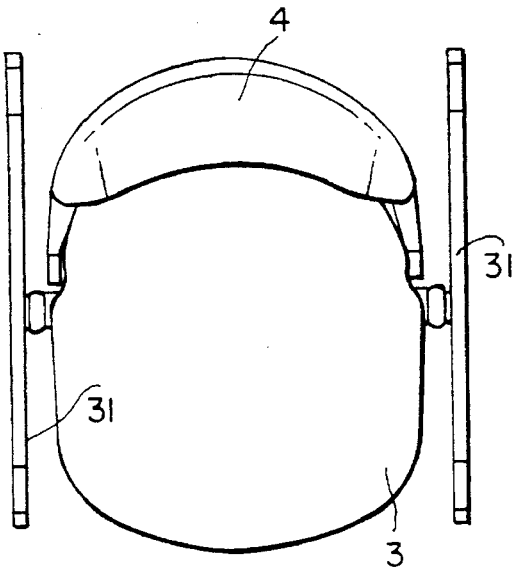
Figure 8:
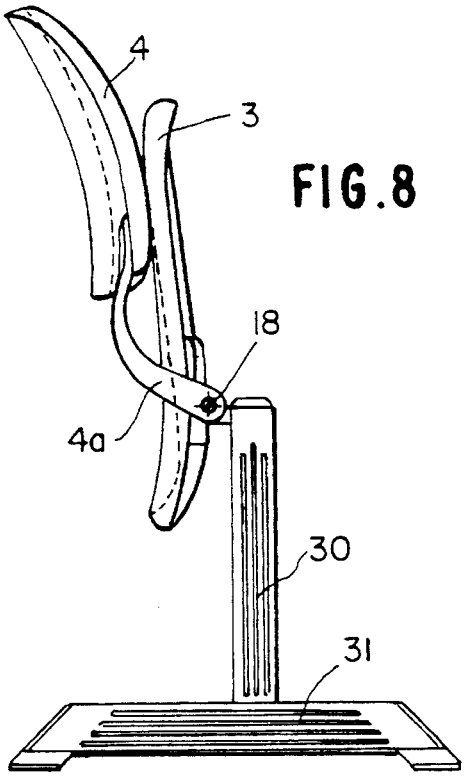
FIG. 8 shows the chair of FIG. 5 in a different operative condition.
Figure 9:
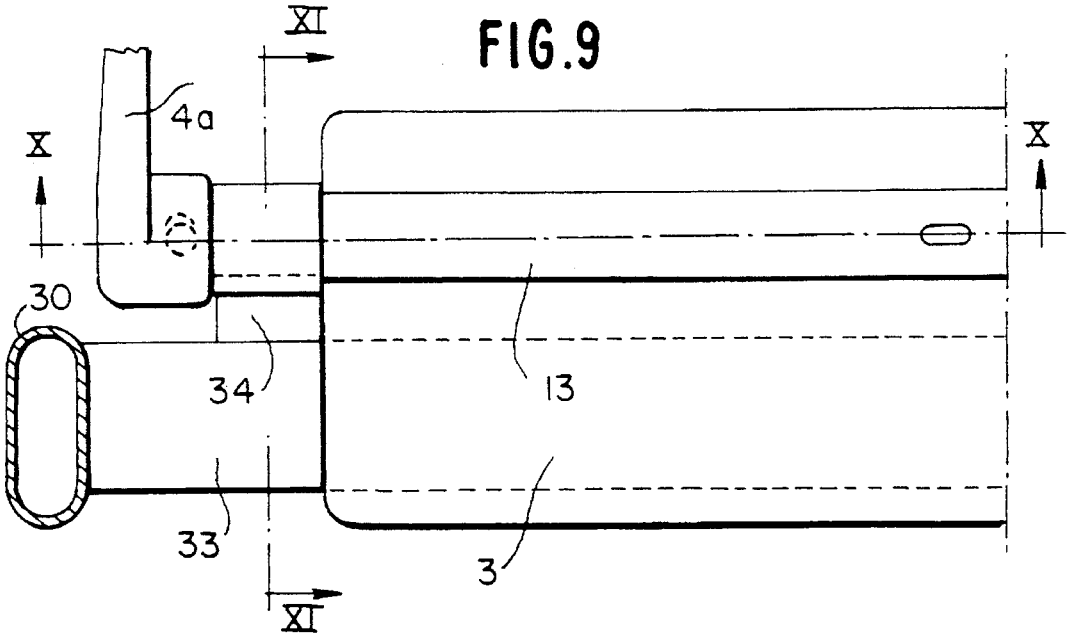
FIG. 9 is a partial view on an enlarged scale and in cross section taken along line IX—IX of FIG. 5, FIGS. 10, 11 show cross sectional views taken along lines X—X and XI—XI of FIG. 9.
Figure 10:
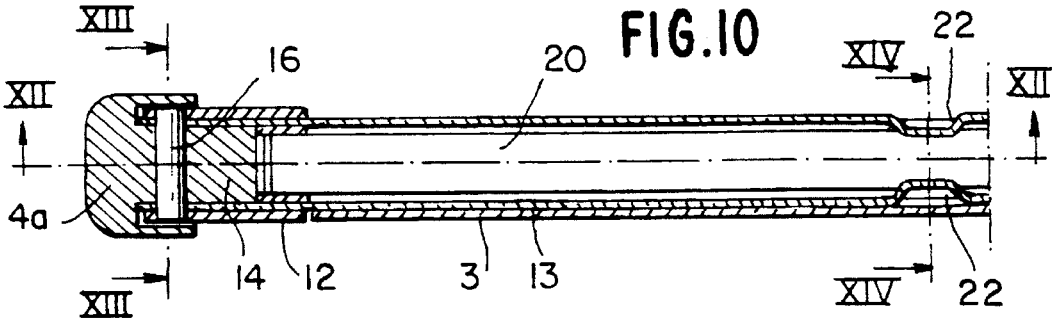
Figure 12:
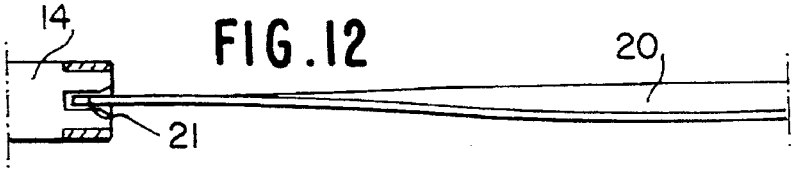
FIG. 12 is a partial cross sectional view taken along line XII—XII of FIG. 10, FIGS. 13–14 are cross sectional views taken along lines XIII—XIII and XIV—XIV of FIG. 10, FIGS. 15–17 show two chairs of the type of FIG. 5 stacked on each other, respectively in a side, front and plan view.
Figure 11:
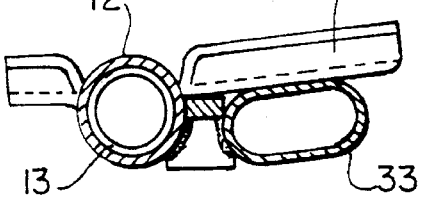
Figure 13:
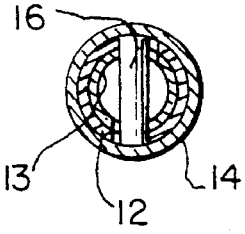
Figure 14:
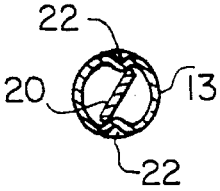
Figure 16:
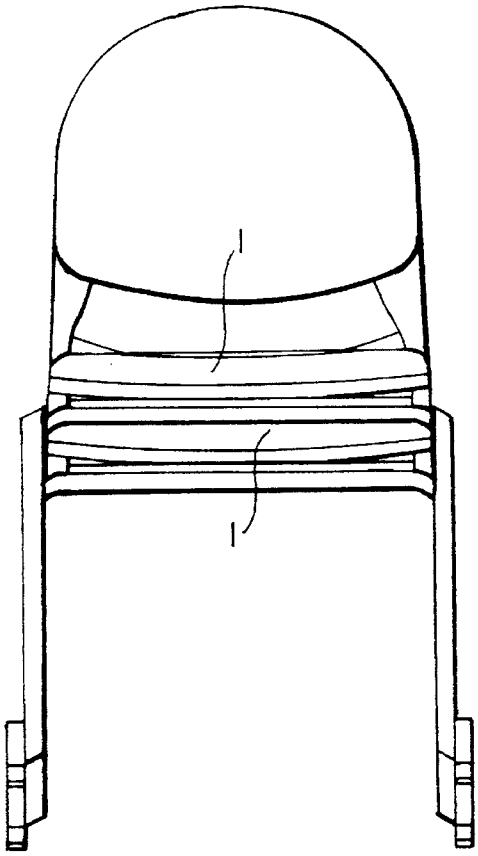
Figure 15:
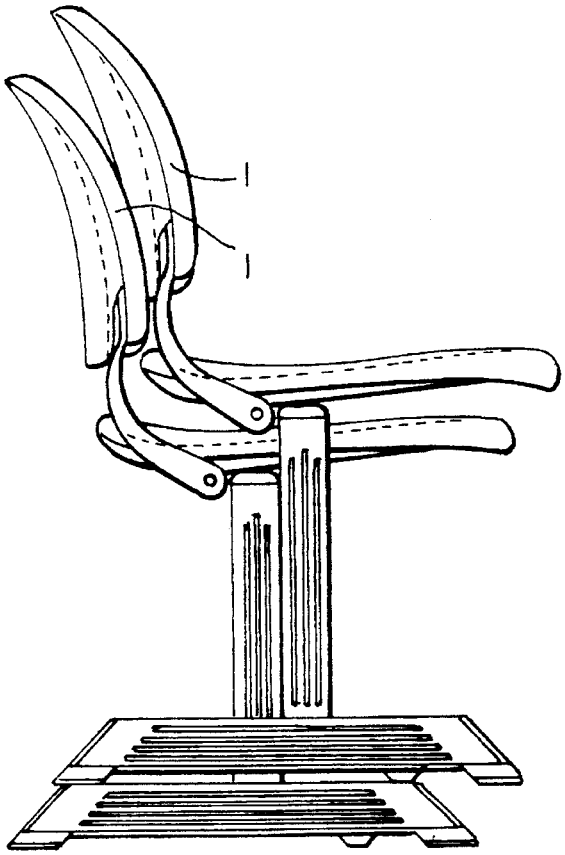
Figure 17:
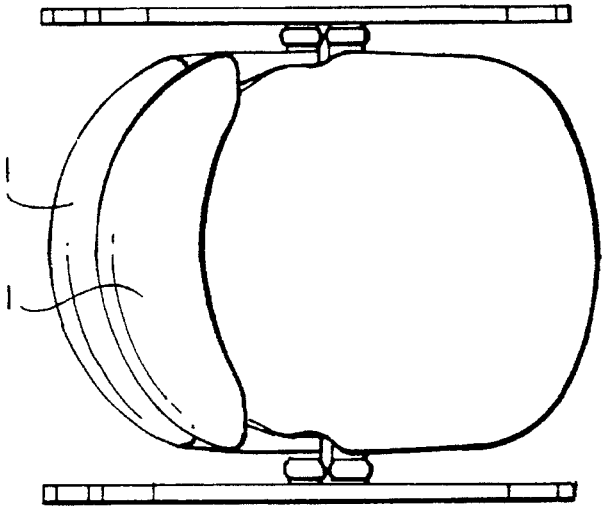
Figure 18:
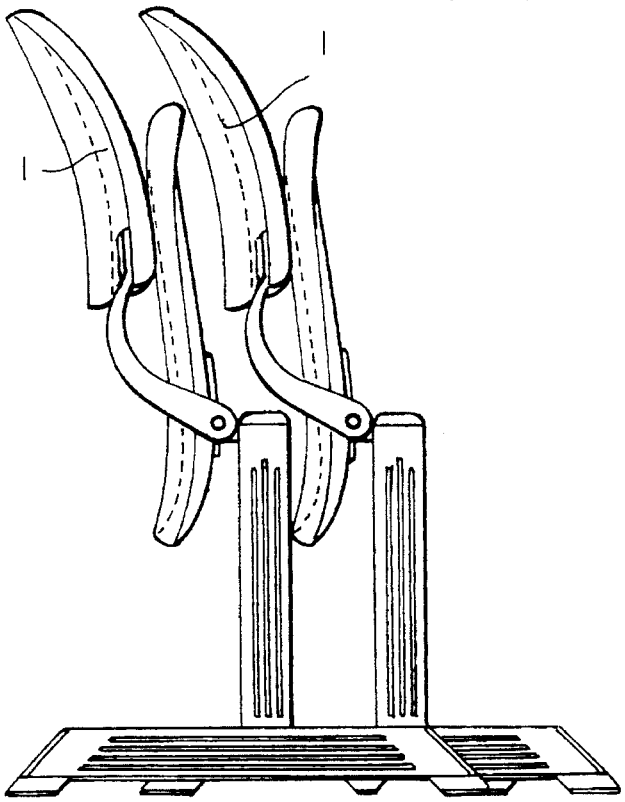
FIGS. 18, 19 are a side view and a plan view of two chairs arranged side by side.
Figure 19:
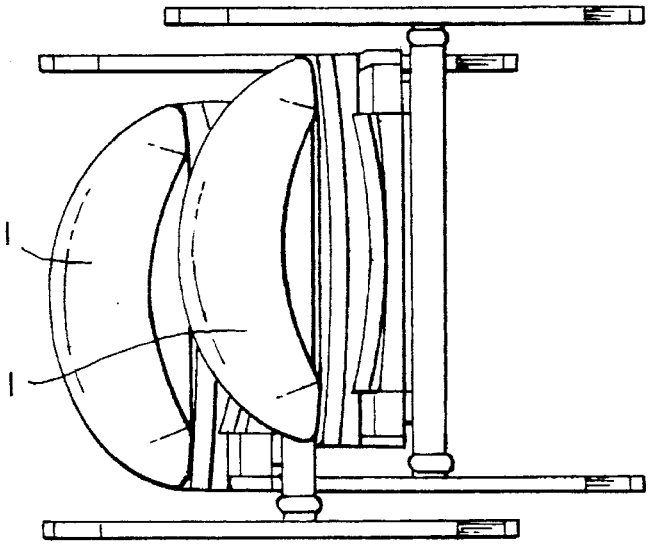

The spring bias of the backrest 4 towards its upright position is obtained by spring means comprising a leaf spring 20 arranged within the tubular cross member 13 and having its ends received within a slot 21 formed axially within pin 14 from its end surface. The central part of the sheet metal tubular cross member 13 has two areas deformed radially inwardly, diametrically opposed to each other, designated by reference numeral 22 in FIG. 2*a*, against which the central part of leaf 20 abuts when backrest 4 is reclined backwardly. The arrangement of each transverse member 16 in the respective circumferential slot 17 is such that the leaf spring 20 is subjected to a load which tends to hold the backrest 4 in its raised position. When the seated person leans against the backrest 4, he exerts a thrust tending to recline the backrest backwardly, against the action of the leaf spring 20. This leaf spring behaves as a pair of torsion bars rigidly connected to the base structure at the centre of the leaf spring and respectively connected to the two side arms 4*a* which support the backrest 4.

As it is clearly apparent from the foregoing description, the chair is characterized by an extremely simple structure, which can be manufactured at low cost, easy and quick to be mounted, while ensuring at the same time a very good comfort and an ergonomically proper posture.

FIGS. 5–14 show a further embodiment of the chair according to the invention. In these figures, those parts which correspond to those of the chair of FIGS. 1–4 are indicated by the same reference numerals. In the case of this embodiment, the base structure of the chair comprises two side uprights 30 provided at their lower ends with two side feet 31 defining a generally inverted T-shaped configuration and connected to each other at their upper ends by a cross member 33. As visible in FIGS. 9, 11, uprights 30 and cross member 33 are formed by sheet metal tubes with an oval and flattened cross section. Cross member 33 is provided with two appendages 34 projecting in a cantilever fashion from two areas adjacent to the ends of the cross member which support bushes 12 (similar to those illustrated with reference to FIGS. 1–4) within which there are welded the ends of the tubular cross member 13. The arrangement of the side arms 4*a* which support the backrest 4, the leaf spring 20 inside the tubular cross member 13, and the pins 14 on arms 4*a* which are rotatably mounted within the ends of tubular cross member 13, is similar to that described with reference to FIGS. 1–4.

In the case of the embodiment shown in FIGS. 5–9, also, the structure of the seat 3 is pivotally mounted on the intermediate portion of the tubular cross member 13, so that the seat 3 may be moved between a position of normal use (FIG. 5) and a raised substantially vertical position (FIG. 8) to make the passage easier for people walking between two adjacent rows of chairs of the same type, in a public place or a conference room. The operation of the chair is absolutely similar to that described with reference to the chair of FIGS. 1–4.

FIGS. 15–19 of the annexed drawings show the possibility of stacking a number of chairs of the same type above each other, while occupying a minimum space, or arranging a number of chairs of the same type in front of each other, with the seats arranged in their raised positions.

From the foregoing description, it is clearly apparent that the mechanism forming the subject of the present invention may be adapted easily to various types of chairs and allows particularly the production of chairs having on one side very good performances from the standpoint of comfort and on the other side a structure which is very simple and of low cost.

What is claimed is:

1. A chair comprising a base structure, a seat supported by the base structure and a backrest having a support structure which is pivotally mounted on the base structure around a transverse horizontal axis and movable between a relatively upright position and a backwardly reclined position, and spring means biasing the backrest towards its upright position, wherein said spring means comprise a leaf spring arranged along said transverse horizontal axis of the backrest support structure and having a central portion operatively connected to said base structure and opposite ends connected to said backrest support structure, and wherein said base structure includes a tubular cross member inside which said leaf spring is arranged, said tubular cross member extending the entire length of said leaf spring and having at its central portion at least an inner stop element adapted to cooperate with said leaf spring to limit rotation of the latter.

2. A chair comprising a base structure, a seat supported by the base structure and a backrest having a support structure which is pivotally mounted on the base structure around a transverse horizontal axis and movable between a relatively upright position and a backwardly reclined position, and spring means biasing the backrest towards its upright position, wherein said spring means comprise a leaf spring arranged along said transverse horizontal axis of the backrest support structure and having a central portion operatively connected to said base structure and opposite ends connected to said backrest support structure, wherein said backrest support structure includes two side arms comprising two coaxial pins which are rotatably mounted within opposite ends of said tubular cross member, each said pin and the respective end of said tubular cross member being provided with stop means cooperating with each other to limit angular tilting movement of said pins with respect to the tubular cross member between two end positions corresponding respectively to the upright position and the backwardly reclined position of said backrest, and wherein said opposite ends of said leaf spring are operatively connected to said two coaxial pins, respectively, whereby when the backrest is in its upright position, each half portion of said leaf spring is subject to a torsion load which tends to hold said backrest in said upright position.

3. Chair according to claim 2, wherein said stop element of the tubular cross member comprises at least one inwardly radially deformed portion of the wall of the tubular cross member.

4. Chair according to claim 3, wherein said stop element of the tubular cross member has at its centre two inwardly radially deformed portions, which are diametrically opposite to each other.

5. Chair according to claim 2, wherein said stop means limiting rotation of said pins with respect to said tubular cross member comprises at least a transverse member mounted on each pin and having at feast one end engaged within a circumferential slot formed in said tubular cross member.

6. Chair according to claim 5, wherein each of said pins has an axial slot which extends from its end surface within which there is received the respective end of said leaf spring.

* * * * *